US006425449B1

(12) United States Patent
Marshall

(10) Patent No.: US 6,425,449 B1
(45) Date of Patent: Jul. 30, 2002

(54) UP-HOLE PUMP-IN CORE BARREL APPARATUS

(75) Inventor: John C. Marshall, South Surrey (CA)

(73) Assignee: Boart Longyear International Holdings, Inc., Salt Lake City, UT (US)

( * ) Notice: Subject to any disclaimer, the term of this patent is extended or adjusted under 35 U.S.C. 154(b) by 0 days.

(21) Appl. No.: 09/779,258

(22) Filed: Feb. 8, 2001

(51) Int. Cl.[7] ..... E21B 25/02
(52) U.S. Cl. ..... 175/236; 175/246; 175/251
(58) Field of Search ..... 175/236, 239, 175/243, 244, 246, 247, 251

(56) References Cited

U.S. PATENT DOCUMENTS

| | | | | |
|---|---|---|---|---|
| 3,292,717 A | | 12/1966 | Hall et al. | |
| 3,333,647 A | | 8/1967 | Karich et al. | |
| 3,874,466 A | | 4/1975 | Fulford | |
| 4,834,198 A | * | 5/1989 | Thompson | 175/244 |
| 5,267,620 A | * | 12/1993 | Lee | 175/230 |
| 5,339,915 A | | 8/1994 | Laporte et al. | |
| 5,592,994 A | * | 1/1997 | Laporte et al. | 175/247 |
| 5,934,393 A | | 8/1999 | Marshall | |
| 6,019,181 A | * | 2/2000 | Soinski et al. | 175/58 |
| 6,029,758 A | | 2/2000 | Novacovicci et al. | |
| 6,089,335 A | * | 7/2000 | Able | 175/246 |

* cited by examiner

*Primary Examiner*—Frank Tsay
(74) *Attorney, Agent, or Firm*—Clayton R. Johnston

(57) ABSTRACT

The drilling apparatus includes a wire line core barrel head assembly that has a latch body seatable on a drill string landing shoulder and retained in a latch seated position by a latch assembly spring urged to a latch seated position, fluid seals on the latch body to facilitate fluidly propelling the head assembly in an upward direction, valve mechanism in a latch body bypass channel to restrict fluid flow therethrough to provide a signal of the latch body seating on the landing shoulder and then opening together with being retractable to an open position by a latch retractor prior to the latch body being retracted and second valve mechanism to block axial outward flow in the bypass channel. The fluid seals are mounted to a latch body adaptor that may be removed to convert from an up-hole to a down-hole assembly.

21 Claims, 4 Drawing Sheets

UP-HOLE PUMP-IN CORE BARREL APPARATUS

BACKGROUND OF THE INVENTION

This invention relates to drilling apparatus and more particularly to mechanism for minimizing the chances of undesired movement of the latches of an underground core barrel inner tube assembly from their latch seated position when the drilling direction is at a hole angle that is above the horizontal prior to mechanically retracting the latch retractor tube.

In at least some prior art underground core barrel inner tube assemblies, there is undesired unlatching in certain situations despite provisions and operational training to avoid such situations. This is primarily due to the pump-in seal being mounted to the latch retracting tube. The latch spring acting between the latches may be overcome and the latches sufficiently retracted when a negative pressure occurs on the "drill side" of the seal due to removal of the water supply at the outer end of the drill string or when a positive pressure occurs on the bit side of the seal due pressurized in-ground water acting to urge the latch retractor tube toward its latch retracting position. Further, the significant mass of the spear head base, seal bypass valving and latch retractor tube can develop sufficient inertia to overcome the latch spring and retract the latches as a result of jerking of the drill string or extreme drilling vibration. With undesired unlatching and the drilling direction being sufficiently great above the horizontal, the core barrel inner tube assembly can move axially outwardly with sufficient force to damage the apparatus at the drilling surface end of the drill string and/or injure drilling personnel.

In U.S. Pat. No. 6,029,758 to Novacovicci et al there is disclosed a retractable core barrel inner tube assembly that includes a drilling apparatus head assembly having valving mechanism to substantially restrict or block fluid flow through its fluid bypass channel, together with being movable to maintain a desired fluid hear in the drill string, and thereafter, being mechanically retractable to an axially outer open position in the fluid bypass channel as the head assembly is retracted in the drill string prior to the latch body being retracted.

U.S. Pat. No. 5,339,915 to Laporte et al discloses a one way retention valve in a core barrel inner tube assembly that functions to retain drilling liquid pressure in lost circulation situations resulting from, for example, drilling into a cavity or into a broken earth formation. Further, a heavy duty spring is used to create a high liquid pressure and retain a column of liquid above the core barrel inner tube assembly.

U.S. Pat. No. 3,333,647 to Karich et al discloses a core barrel inner tube assembly having spring mechanism acting between a latch body and a latch release tube to constantly urge the latch release tube to a position permitting the latches moving to a latch seated position.

In order to make improvements in underground core barrel inner tube assemblies to minimize undesired unlatching of an underground inner tube assembly in up-hole drilling (a drilling direction above the horizontal, this invention has been made.

SUMMARY OF THE INVENTION

A drilling assembly that is movable in a drill string to the inner end portion thereof for being latchingly retained therein includes a latch body having latch retracting mechanism mounted thereon for limited axial movement relative thereto for retracting the latches of the latch assembly from a latch seated position. The latch body is of a three part construction with each latch body part defining a part of a fluid bypass channel with the intermediate part being removable from the other two parts and having a seal member thereon to form a fluid seal between the latch body and the drill string. Spring mechanism acts between the latch body and the latch mechanism to constantly urge the latch mechanism to its latch seated position. A drilling tool is attached to the latch body to extend inwardly thereof, the tool being any one of, for example, a core barrel inner tube, a plug bit, an earth sampling tube and etc.

One of the objects of this invention is to provide new and novel means in up-hole drilling apparatus that is latchingly coupleable in a drill string for rendering a safety feature to minimize the chances of accidental unlatchingly coupling from a drill string during up-hole drilling operations. Another object of this invention is to provide in a drill head assembly, a new and novel latch body assembly that may be readily converted between one primarily for underground (up-hole) use and one primarily for down-hole use.

For purposes of facilitating the description of the invention, the term "inner" refers to that portion of the drill string, or of the assembly, or an element of the assembly being described when, in its position "for use" in, or on, the drill string is located closer to the drill bit on the drill string (or bottom of the hole being drilled) than any other portion of the apparatus being described, except where the term clearly refers to a transverse circumferential, direction, or diameter of the drill string or other apparatus being described. The term "outer" refers to that portion of the drill string, or of the assembly, or an element of the assembly being described when, in its position "for use" in, or on, the drill string is located axially more remote from the drill bit on the drill string (or bottom of the hole being drilled) than any other portion of the apparatus being described, except where the term clearly refers to a transverse circumferential, direction, or diameter of the drill string or other apparatus being described.

DETAILED DESCRIPTION OF THE INVENTION

Figure 1A:
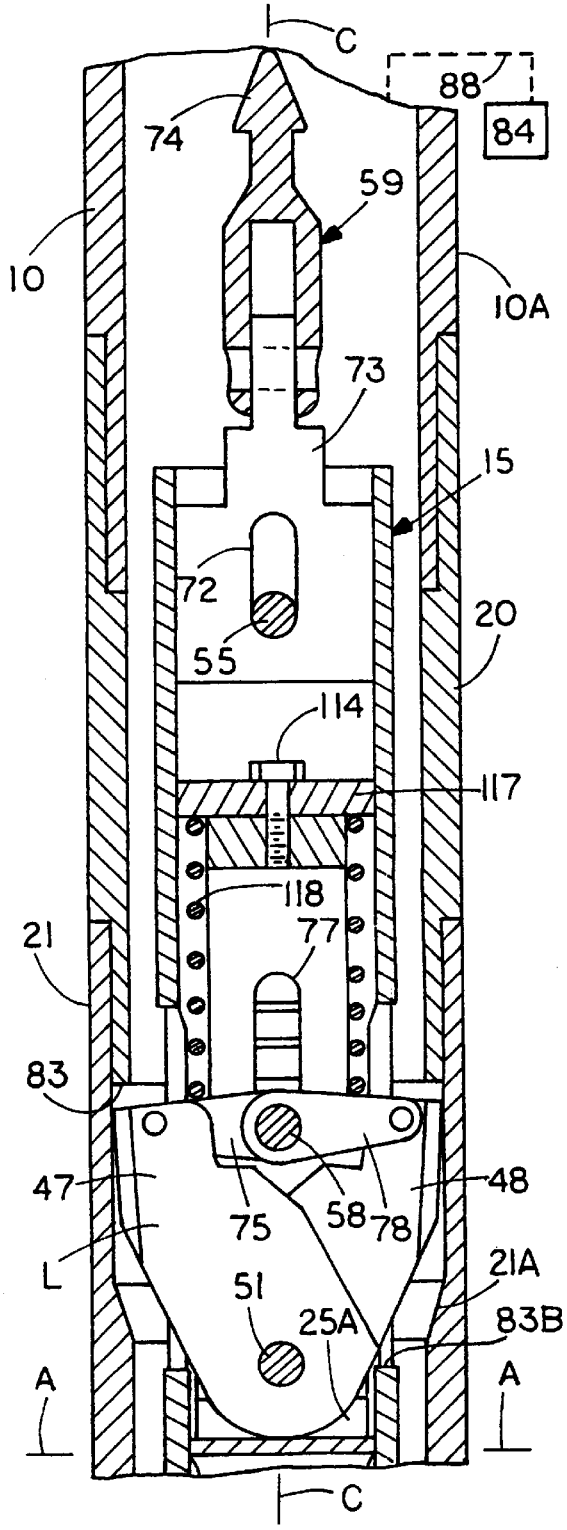
FIGS. 1A, 1B, 1C and 1D when arranged one above the other with their axial center lines aligned and lines A—A and B—B of FIGS. 1B and 1B aligned, lines E—E and F—F of FIGS. 1B and 1C aligned and lines G—G and H—H of FIGS. 1C and 1D aligned, form a composite longitudinal section through the drilling apparatus of the first embodiment of this invention with the core barrel inner tube assembly seating on the drill string landing ring; said view being generally taken along the line and in the direction of the arrows 1A, 1B–1A, 1B of FIG. 2 with axial intermediate portions broken away.
Figure 1B:
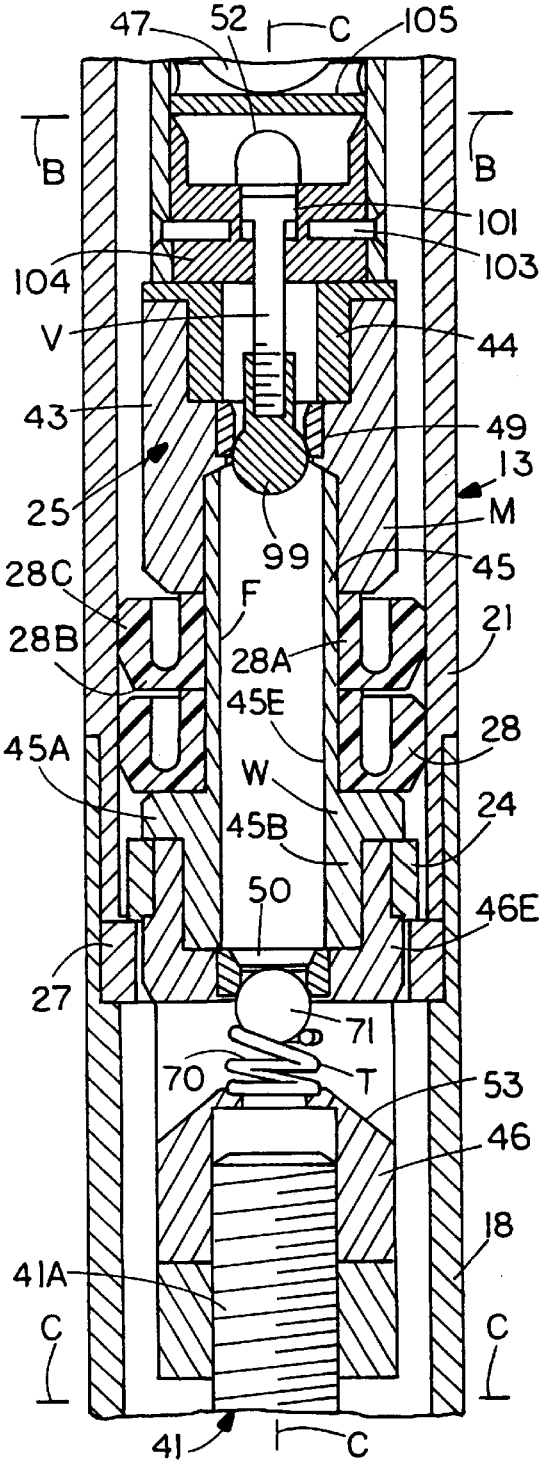
Figure 1C:
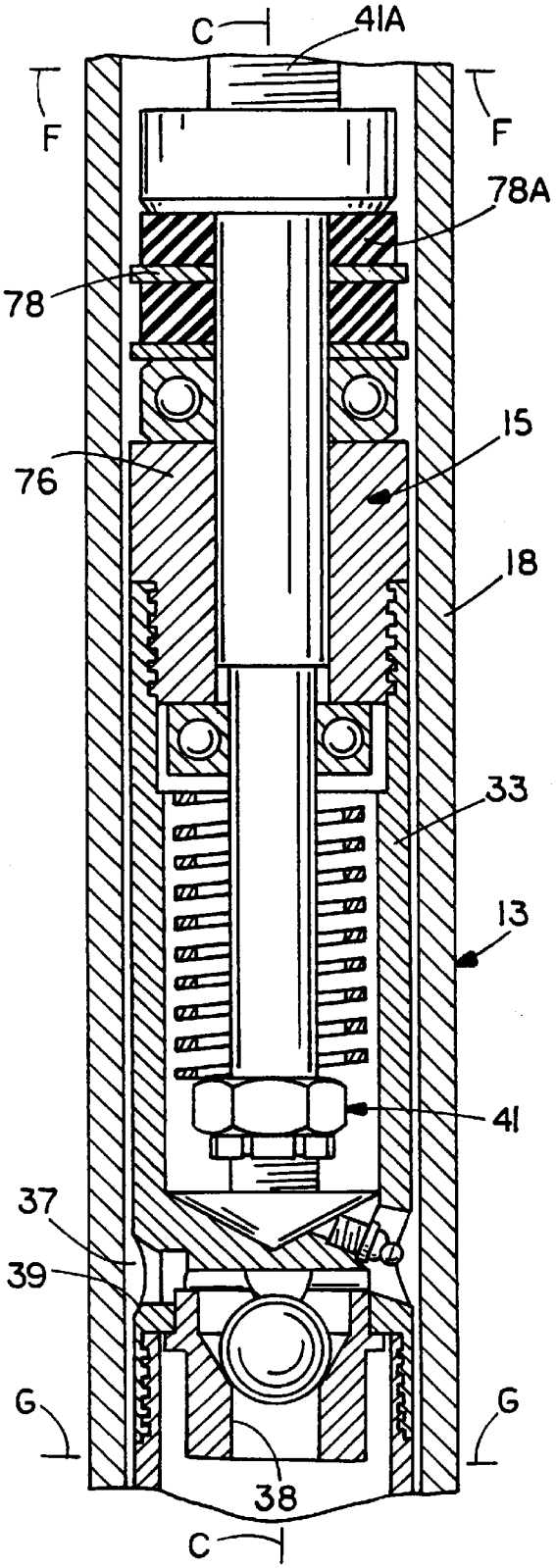
Figure 1D:
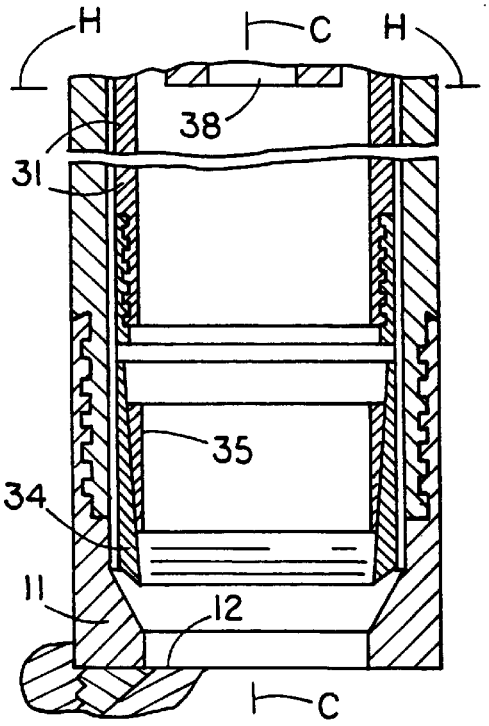

Referring now in particular to FIGS. 1A, 1B and 1C, there is illustrated a hollow drill string 10 which is made up of a series of interconnected hollow drill rods (tubes). Even through the drilling direction is not shown as being upwardly, the drill string 10 is in an upwardly extending bore hole 12 drilled in rock or other types of earth formations by means of an annular core bit 11 which is at a higher elevation than the axial outer end of the drill string. The pump apparatus located at the drilling surface and indicated by block 84 pumps fluid under pressure through line 88 into the outer end of the drill string 10 in a conventional manner. The bit in the bore hole 12 may be at a considerable elevation above the drilling surface but at a considerable depth below the earth surface.

The portion of the drill string attached to or extended below the pipe (rod) section 10A is commonly referred to as a core barrel outer tube assembly, generally designated 13, the core barrel outer tube assembly being provided for receiving and retaining the core barrel inner tube assembly, generally designated 15, adjacent to the bit end of the drill string. Details of the construction of the core barrel outer tube assembly used in this invention may be of the general nature such as that disclosed in U.S. Pat. Nos. 3,120,282 and 3,120,283. The outer tube assembly is composed of an adaptor coupling 21 that is threadedly connected to the core barrel outer tube 18 to provide a recess in which a drill string landing ring (drill string landing shoulder) 27 is mounted. A reaming shell 19 is joined to the inner end of tube 18 with an annular drill bit 11 at the inner end of the reaming shell for drilling into the earth formation from which the core sample is taken. The outer end of the assembly 13 includes a locking coupling 20 that connects the adaptor coupling 21 to the adjacent pipe section 10A of the drill string. At the opposite end of the coupling 20 from the pipe section 10A, the locking coupling, in conjunction with the annular recess of the adaptor coupling 21, form a latch seat 21A inside of the surface of the adaptor coupling against which the latches 47, 48 of the latch assembly L are seatable for removably retaining the core barrel inner tube assembly 15 adjacent to the core bit. The inner end portion of the locking coupling may have a conventional projection flange (not shown) to bear against a latch to cause the latches and other portions of the inner tube assembly to rotate with the drill string when the latches are in a latched position, as is conventional.

The assembly 15 includes a core receiving tube 31, an inner tube cap 33 threaded to the outer end of the core receiving tube and a spindle and bearing subassembly, generally designated 41, connecting the cap to the inner portion 46 of the latch body. The subassembly 41 includes a spindle bolt 41A threadedly connected to the inner body portion of the latch body, and connects the cap to the latch body for limited movement in a conventional manner. The subassembly 41 also includes bearing mechanism 76 axially slidably on the spindle bolt, the mechanism including a bearing member threaded to the inner tube cap. Conventional shut-off valve mechanism 78 is provided on the spindle bolt between the bearing mechanism and a spindle bolt enlarged diametric portion to have its resilient members 78A expand in girth as they are compressed to form a fluid seal with the inner periphery of the drill string when the core receiving tube is filled or there is core blockage to provide a high pressure fluid signal as is conventional.

The core receiving tube has a replaceable core lifter case 34 and a core lifter 35, the structure and function of which may be generally the same as set forth in U.S. Pat. No 2,829,868. A fluid passageway 39 formed in the cap 33 opens through a valve subassembly 38 to the interior of the outer end of the core receiving tube and at the opposite end to the annular clearance space 37 between the inner tube assembly and the outer tube 18 that forms a part of the annular fluid channel 37 to, in conjunction with the latch body bypass channel F, permit fluid to bypass the inner tube assembly when in a core taking position. The structure of, the function of and the manner of the mounting of the spindle-bearing subassembly may be very similar to that described in greater detail in U.S. Pat. No. 3,305,033.

The core barrel inner tube assembly 15 also includes a latch body, generally designated 25, having a main body portion 44, the inner body portion 46 and an axial intermediate, annular adaptor subassembly M threadedly connecting the adjacent ends of the main body and inner body portions to one another. The adaptor subassembly includes an axial inner adaptor part 45 which has an enlarged diametric flange 45A and an axial inner, reduced outer diameter part 45B extended into and threadedly connected to the inner body portion axial outer part 46E to cooperatively provide a radially outward annular groove to removably mount a latch body ring 24 which is of a larger outer diameter than any other part of the latch body. Thus, the latch body ring provides a latch body shoulder that is seatable on the drill string shoulder (landing ring) 27, the landing ring 24 and flange 45A and the enlarged diametric portion 46E of the adaptor subassembly cooperatively providing a maximum enlarged diameter latch body portion. It is to be understood that in place of a landing ring 27, the axial outer part of adaptor part 46 may be of a larger outer diameter such as of the outer diameter of the landing ring 24 to provide a latch body landing shoulder seatable on the drill string landing shoulder.

Figure 2:
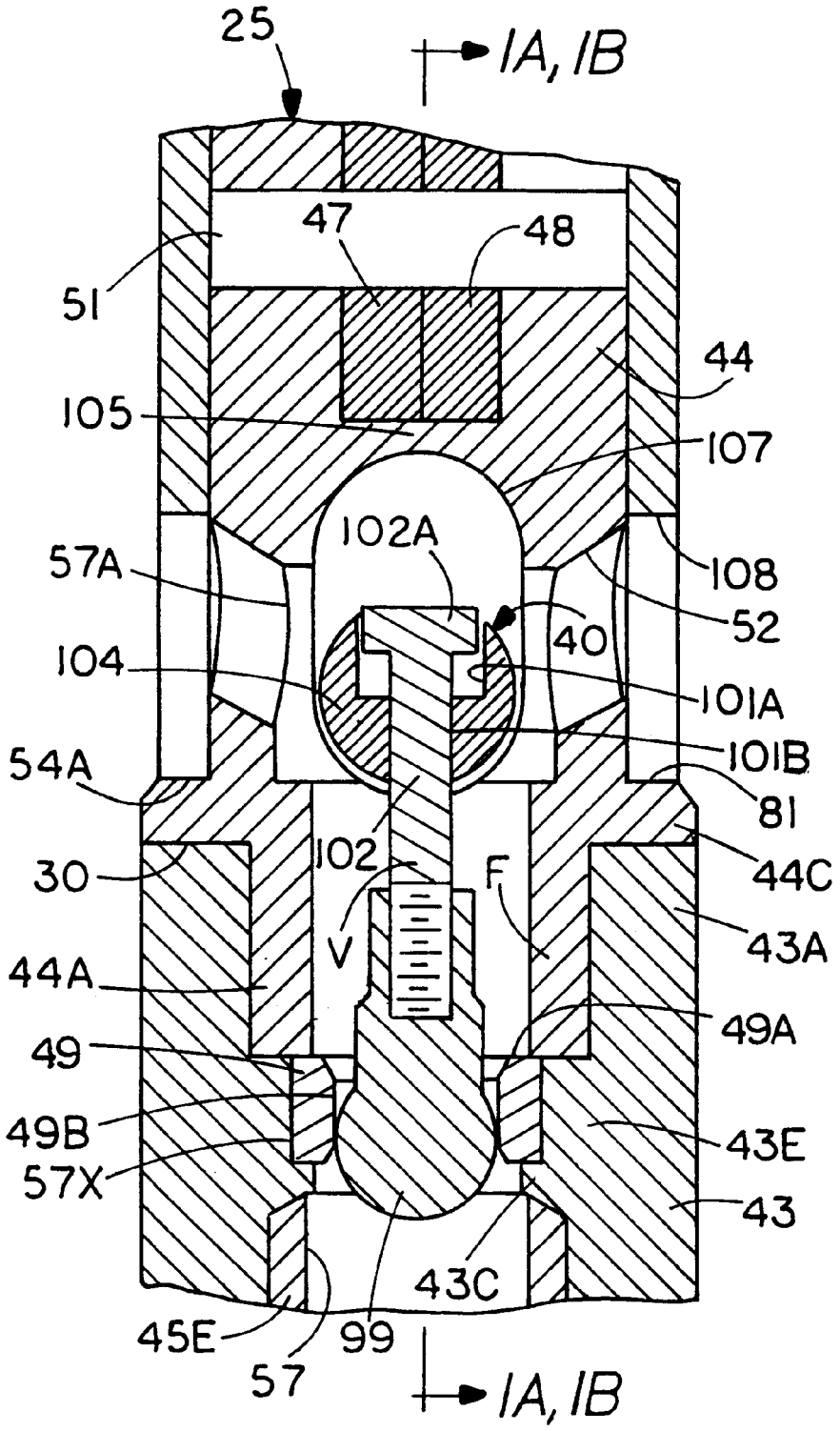
FIG. 2 is an enlarged, fragmentary longitudinal sectional view of the first embodiment with the landing indication valve assembly ball portion having been inwardly forced partially through the adjacent bushing.
Figure 3:
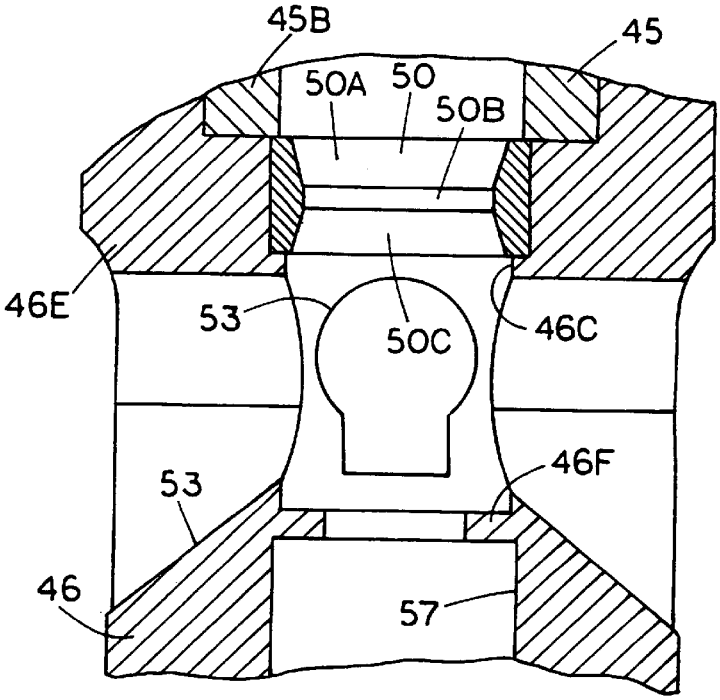
FIG. 3 is an enlarged, fragmentary longitudinal view of the latch body portion of the first embodiment in which the liquid retention valve assembly is mounted, said valve assembly not being shown.

Referring to FIG. 2, the reduced outer diameter, axial inner end portion 44A of the main body portion 44 is threaded into the axial outer annular portion 43A of the adaptor outer part, portion 43A being of an inner diameter that is greater than the inner diameter of the adjacent intermediate annular portion 43E of the adaptor outer part. Portion 43E is of a greater inner diameter than the diameter of the axially adjacent annular portion 43C to which it opens. Part 44A and portions 43C and 43E cooperatively providing a radially inwardly opening groove in which a bushing 49 is mounted.

The latch body portions 43, 44, 45 and 46 cooperatively provide a fluid bypass channel F that includes inlet ports 52 in main body portion 44 that opens to an axial bore (chamber) 57 inwardly of the bore outer end and outwardly of the enlarged diameter flange 44C of the main body portion 44, and outlet ports 53 in the inner body portion that open to the bore 57 axially inwardly of a bushing 49. The fluid bypass channel F permits fluid flow to bypass the drill string landing ring 27 and the latch body ring 24 when the ring 24 is seated on the ring 27. That is, other than for the fluid seals 28, the portions of the inner tube assembly from the latch body ring 24 axially inwardly and outwardly are of smaller maximum diameters than the maximum outer diameter of the ring (latch body shoulder) 24 while the bypass channel has ports 52 opening exterior of the latch body axially outwardly of the ring 24 to the annular clearance space outwardly of the ring 24 and radially between the latch body and the drill string and second ports 53 opening exterior to the annular clearance space axially inwardly of the ring 24 and radially between the latch body and the drill string. The latch body landing ring, when seating on the drill string landing ring, blocks or severely restricts axial inward flow therebetween. The bushing 49 constitutes part of a two way liquid landing indicator valve mechanism, generally designated 40, for controlling fluid flow through the latch body fluid bypass channel F and providing a high pressure signal at the drilling surface when the latch body landing ring has seated on the drill string landing ring and the latches have moved to their latch seated position. The bushing is mounted in an axially intermediate diameter portion 57X of the bore 57 which is formed in the adaptor outer part 43 to abut against a transverse outwardly facing annular shoulder of adaptor portion 43C with the bushing being located axially intermediate of the opening of the ports 52 and 53 to bore 57. Except for the minimum diameter of a bushing 50, the minimum diameter (axial intermediate cylindrical surface portion 49B) of the bushing 49, when mounted in bore 57, is substantially smaller than any portion of the bore 57 axially intermediate the openings of the inlet and outlet ports to bore 57. The bushing 49 has an axial outer frustoconical portion 49A and an axial inner frustoconical portion with the minimum diameter cylindrical portion 49B extending therebetween.

The valve mechanism 40 also includes valving assembly V that comprises a valve ball member 99. The valve ball member 99 is axially movable in the bore 57 and has an inner ball portion 99A which is partially spherical with a transverse maximum diameter section that is of a diameter slightly less than the minimum diameter of the bushing cylindrical surface portion 49B if the bushing is made of metal, but may be greater than the minimum diameter of portion 49B if the bushing is made of a resilient material. In either event, the maximum transverse diameter section of the ball member is such that said section is movable axially inwardly through at least the minimum diameter portion 49B of the bushing and, when in the minimum diameter portion, blocks or substantially restricts fluid flow through the bypass channel.

The outwardly extending non-spherical part of the ball portion of the valve ball member is threadedly mounted to a valve stem (shaft) 102. The valve stem is axially slidably extended and rotatable in an axial bore 101 in the transverse, generally cylindrical stem mount 104, bore portions 101A, 101B forming an outwardly facing shoulder to have the enlarged head portion 102A of the valve stem abut thereagainst for limiting the inward axial movement of the valve stem relative to the stem mount. The stem mount is mounted in a fixed axial position to and within the inner end portion of the latch retractor (tube) 54 by screws 103 to move axially therewith.

As the latch retractor 54 is moved to its maximum axial outer position relative to the latch body, the ball portion 99 is moved to a valve open first position axially outwardly of the bushing 49 to permit maximum fluid flow through the bushing. When the latches are in abutting relationship to the drill string as the core barrel inner tube assembly moves inwardly in the drill string the latches are retained in a position pivotally intermediate their latch seated and latch retracted positions. With the latches being retained in their intermediate position, the latch retractor is prevented from moving to an axial inner position relative to the latch body and is retrained in a position relative to the latch body axially intermediate its maximum and minimum axial positions relative to the latch body as a result of pin 58 being prevented from moving further inwardly relative to the latch body until the latches move to their latch seated position. With the latches and latch retractor in their intermediate position, the ball portion 99 has moved to and retained in an axial inner valve second position to have its maximum diametric section radially aligned with bushing portion 49B to restrict or block inward fluid flow through the bushing. When the latch body landing ring has seated on the drill string landing ring, both of the latches moved to their latch seated position and the latch retractor abuts against the latch body flange 44C, the ball portion 99 is movable under fluid pressure to a valve open third position to have its transverse maximum diametric section inwardly of the bushing portion 49B to permit increased fluid flow through the bypass channel, provided fluid is under sufficiently high inward pressure to move the valve ball 70 inwardly out of engagement with the bushing 50.

The stem mount axially movably extends through the main body portion stem mount slot 107 with either the slot 107 and/or the movement of a retractor pin 58 in a latch body retractor pin slot 77 limiting the axial movement of the stem mount relative to the latch body. The slot 107 opens to the axial outer bore portion 57A of bore 57 axially inwardly of the outer end of the bore portion 57A (see FIG. 2) with at least the major part of the stem mount being movable outwardly of the opening of the ports 52 to bore portion 57A to decrease the resistance to axial inward fluid flow through the bypass channel. Bore portion 57A is formed in the main body portion of the latch body with the diameter of the stem mount being substantially less than the maximum transverse dimension of the bore portion 57A. The stem mount, valve stem and the adjacent parts of fluid bypass channel may be the same or similar to that set forth in U.S. Pat. No. 6,029,758 whereby the fluid flow through the bypass channel F is not significantly reduced by the valving assembly V when the latch retractor is in its axial outer position relative to the latch body.

Axially inwardly of the opening of the ports 53 to bore 57, the inner body portion 46 has a minimum diameter bore portion 46F to provide an annular, axially outwardly facing shoulder against which is seated the inner end of a coil spring 70 that is part of the liquid retention valve subassembly T. The opposite end of the spring constantly resiliently urges the valve ball 71 against the axial inner frustoconical valve seat 50C of the bushing 50 to block axial outward fluid flow through the bushing. The bushing 50 has an axial intermediate, minimum diameter cylindrical portion 50B and an axial outer frustoconical portion 50A. Advantageously the bushing 49 and 50 are of the same shape and size with bushing 50 being made of metal to prevent the valve ball 71 being movable axially therethrough.

The bushing 50 is seated in a radially inwardly opening annular groove defined by the inner body portion reduced diameter part 46C which is axially outwardly adjacent to the opening of the ports 53 to the bore 57, the annular surface of part 46E that extends between part 46C and outer adaptor part 45B, and the transverse inner surface of part 45B. The valve ball 71 is of a smaller diameter than the inner diameter of part 46C so that it can be inserted into the bore 57 before the bushing 50 is mounted in bore 57. The bushing 50 is located in the bore 57 axially inwardly of bushing 49.

The axial outer, annular portion 45E of the axial inner adaptor part 45 is of a reduced outer diameter and of an axial length to have its outer end threaded into adaptor outer part 43 and to mount resilient fluid seals members 28 to abut against the inner transverse surface of the outer adaptor part 43 and portion 45A of the inner adaptor part. Each of the seal members 28 includes a radial inner, axially elongated annular portion 28A bearing against the outer peripheral surface of portion 45E of the inner adaptor part 45 and a web 28B joined to the axial inner end portion of the radial inner portion 28A and to the inner end portion of the radial outer, axially elongated annular portion 28C to provide an axially outwardly opening annulus between portions 28A, 28C. Portion 28C has an outer peripheral cylindrical portion surface to at least substantially form a fluid sealing fit with the inner peripheral wall of the drill string as the inner tube assembly moves axially inwardly in the drill string. Advantageously, the fluid seals 28 are of a construction the same as or similar to the seal member of the overshot assembly of U.S. Pat. No. 5,934,393 that forms a fluid seal with the drill string and thus will not be further described. The fluid seals 28 block fluid flow bypassing the inner tube assembly through the clearance space between the inner tube assembly and the inner peripheral wall of the drill string, but permits fluid bypassing the inner tube assembly through the bypass channel F when valve assemblies V and T are out of fluid blocking positions with bushings 49 and 50 respectively.

When the latches are in a latch seated position with the retractor transverse inner edge 54A abutting against annular flange 44C, the retractor has notches 108 that open inwardly through the inner edge 54A and extend outwardly the same distance that radially adjacent ports 52 extend to form part of the fluid bypass channel F when the core barrel inner tube assembly is in a core taking position, see FIG. 2. Advantageously, the parallel axial extending edges of the notches are of a spacing about the same as the diameter of the ports 52.

The core barrel inner tube assembly also includes a latch assembly L having the pair of latches 47, 48 with their axial inner end portions pivotally mounted in a latch body slot 25A by a pivot member 51 that is mounted to the latch body. The pin 58 mounts the latch retractor (release tube) 54 to the latch body for limited axial movement relative thereto for retracting the latch assembly from its latch seated position to its latch release position and alternately permitting the latch assembly moving to its latch seated position when the latches are radially adjacent to the latch seat.

The latch assembly L also includes a toggle linkage subassembly having generally transversely elongated toggle link members that include toggle links 75, 78 pivotally mounted by pivot link pins to the axial outer ends of portions of the latches 47, 48 respectively for pivotal movement of the latches between a latch retracted position and an extended latch seated position of FIG. 1A (or an overcentered locked position, for example such as shown in the above mentioned patent to Harrison). The horizontally extending retractor pin 58 extends transversely through link apertures in the adjacent ends of the links and the axially elongated slot 77 of the latch body. The opposite ends of the pin 58 are mounted in fixed axial relationship to the latch retractor and form a lost motion pivotal connection between the latch body, the latches and the latch retractor tube 54. The axial outward movement of the latch retractor tube relative to the latch body is limited by the pin 58 abutting against the outer edges of the latch body that in part define slots 77 and the axial inward movement is limited by one of the pin 58 abutting against the axial inner edges of the slots 77 and the annular, axial inner edge portion 54A of the latch retractor tube abutting against the annular flange 44C. The pin 58 retracts the latch body when the pin 58 abuts against the outer ends of the slots 77 and is moved axially outwardly.

A spring mount comprising an annular member 117 and a fastener (bolt) 114 threadedly connected to the main body portion 44 retain the annular member 117 in abutting relationship to the axial outer transverse surface of the latch body main portion 44. An axially extending coil spring 118 is provided on the axial outer part of the main body portion to have one end abut against the annular member 117 and its opposite end abut against the pin 58, and may abut against the toggle links 75, 78, to constantly resiliently urge the pin axially inwardly and thereby the latch retractor tube and the latches toward their latch seated positions with at least one of the retractor pin 58 abutting against the axial inner edge of the latch body slots 77 and the axial inner terminal edge portion 54A of the latch retractor abutting against the shoulder 81 of the enlarged diametric portion 44C of the main body portion 44.

A pin 55 is fixedly mounted to the outer end portion of the latch retractor tube and is extended through an axially elongated slot 72 in the plug 73 of the overshot coupling device, generally designated 59. Thus, the plug 73 may be moved relative to the latch retractor to an axial inner position and an axial outer position for retracting the latch retractor. The device 59 includes a spear point 74 that is joined to the plug 73. Even though the overshot coupling device 59 shown may be of substantially the same construction as that described in U.S. Pat. No. 4,281,725 and function in the same manner, it is to be understood that other overshot coupling devices can be used.

When the core barrel inner tube assembly is in its core taking position of FIGS. 1A and 1B with the latches in their latch seated position, the inner annular edge 54A of the latch retractor tube abuts against the axially outwardly facing shoulder 81 of the annular flange 44C. The latches are extendable radially outwardly through the retractor tube slots 83 and the axial inner ends of slots 83 may or may not abut against latches to retract the latches from their latch seated position as the retractor tube is retracted. Advantageously, the slots 83 may be angularly spaced relative to the slots 108.

Figure 4:
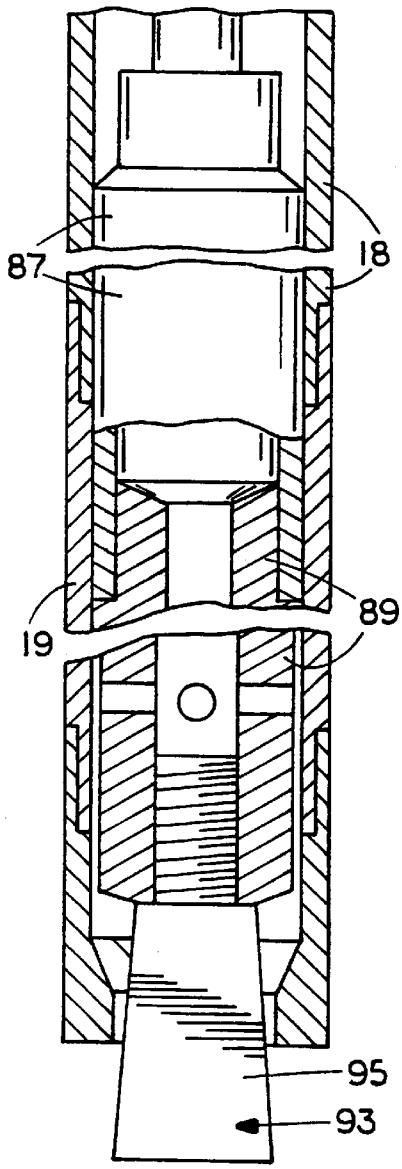
FIG. 4 is a longitudinal cross sectional view of the inner end portion of a second embodiment of the invention which shows a drag bit.

The second embodiment of the invention (see FIG. 4), generally designated 93, includes a latch body, a latch assembly, valving mechanism and latch retracting mechanism that may be the same as that disclosed with reference to FIGS. 1A, 1B and 2. However, instead of the spindle subassembly 41, there is provided a conventional earth sampler spindle 87 that at its outer end is threadedly connected to the inner body portion 46 of the latch body and at its inner end is threadedly connected to a drag bit mounting sub 89. The sub 89 threadedly mounts a drag bit 95 to extend through and inwardly of the drill bit 11. The sub is of a type that rotates the drag bit when the bit 11 is rotated.

As may be apparent from the above description, the latch body, latch assembly, valve mechanism and the latch retracting mechanism, including the overshot coupling device provide a head assembly that may be attached to a variety of drilling tools or devices that are to be inserted in a drill string and removably latched to the inner end portion of the drill sting.

In using the apparatus of this invention in, for example, up-hole drilling, the core barrel inner tube assembly of either the first or second embodiment is inserted into the outer end of the drill string and as fluid under pressure is pumped in the drill string, the assembly moves axially inwardly. As fluid under pressure flows inwardly and the spring 118 acting against pin 58, the overshot coupling device and latch retractor are forced inwardly relative to the latch body, but the latches are prevented from moving to their latch seated position of FIG. 1A as a result of the latches abutting against the inner periphery of the drill string which limits the inward movement of the pin 58 in the latch body slots 77 to a position the maximum transverse diameter part of the ball portion 99 is located in the minimum diameter part 49B of the bushing 49. At this time, the pin 58 prevents the inner transverse edge of the latch retractor abutting against flange 44C.

Upon the latch body landing ring 24 seating on the drill string landing ring, the inward movement of the inner tube assembly is stopped and, with the latches opposite the latch seat 21A, spring 118 forces the latches to move to their latch seated position and the retractor tube moves inwardly relative to the latch body to abut against flange 44C. Since the maximum diametric section of ball member 99 is located in the minimum diameter portion of bushing 49 to substantially restrict inward fluid flow (block or limit inward flow to leakage flow) through the bypass channel and/or the landing ring 24 seating on ring 27 and/or spring 70 retaining ball 71 against valve seat 50C, the fluid pressure at the drilling surface builds up to provide a high pressure signal to indicate the inner tube assembly is in a position for taking a core. It is noted that at this time the enlarged diametric portion 102A is axially outwardly of the juncture of bore portions 101A and 101B.

In the event one of the latches does not move to its latch seated position, pin 58 and the latch retractor are prevented from moving inwardly relative to the latch body sufficiently that the maximum transverse diameter section of ball member 99 can move inwardly of the bushing portion 49B. Accordingly, any significant fluid flow through the fluid bypass channel is blocked even though the latch body has seated on the drill string landing ring.

With the latches in their latch seated position, upon increasing the pump-in fluid pressure, or if the pump-in pressure is sufficiently high, the fluid force acting on the valving assembly V forces ball member 99 inwardly to have the ball member maximum transverse diametric section sufficiently inwardly of the bushing portion 49B to be radially opposite or inwardly of the bushing inner frustoconical portion to increase the annular clearance space between the ball member and bushing 49, together with forcing the valve ball 71 inwardly relative to bushing portion 50C to permit axial inward fluid flow through the bypass channel. Thus, the annular clearance space between the ball portion 99A and the bushing 49 and the annular clearance space between frustoconical surface 50C and ball 71 increase with increasing pump-in fluid pressure to permit increased rate of fluid flow through the bushings and thereby increased axial inward flow through the bypass channel F. Once the ball member 99 moves inwardly to its full valve open position with valve stem portion 102A abutting against the shoulder defined by bore portions 101A, 101B, it remains in its open position until retracted as a result of the retraction of the latch retractor.

Advantageously, the characteristics of spring 70 are such that the fluid force required to force the valve ball out of engagement with the bushing 50 is much greater than the force required to force the maximum transverse diameter section of ball member 99 inwardly of the minimum diameter portion 49B of the bushing 50. In many core drilling operations it is desirable to have a very high drilling pressure and as a result a spring 70 is used whereby a very high fluid pressure is required to move the ball inwardly of the valve seat 50C. With the spring 70 acting against the valve ball, fluid flow outwardly through the ports 53 to the bore 57 (back pressure) is blocked and such back pressure acting against the fluid seals 28 together with that acting against the latch body does not result in the inner tube assembly moving axially outwardly since the back pressure does not act against the latch retractor to move to its latch retracting position and the spring 118 acting against the latches retains them in their latch seated position to prevent the latch body moving axially outwardly.

When, because of a core jam in the inner tube or the desired length of core has been taken, the core drilling is stopped together with retracting the drill string sufficiently to break the core from the earth formation, the pumping in of drilling fluid is discontinued and a conventional underground overshot assembly (not shown) is inserted into the drill string and pumped in to move to couplingly engage the overshot coupling device 59. As one example, the overshot may be of a construction such as set forth in U.S. Pat. No. 3,120,283. If the pumping in of fluid is discontinued or the pump-in pressure is decreased, the spring 70 moves the bali 71 outwardly or retains it in a position to block axial outward fluid flow through the bushing 50 and in the bore 57 to bushing 49.

The initial retraction of the overshot coupling device acts to apply a retraction force to pin 55, if not already applying such a force, to retract pin 55. The retraction of pin 55 retracts the latch retractor which moves the stem mount 104 outwardly to retract the ball member 99 and pull it through the bushing 49 to have its maximum transverse diameter section axially outwardly of the axial outer frustoconical portion 49A of bushing 49. As the transverse maximum diameter section of the ball member 99 is moved axially outwardly of bushing portion 49B, the resistance to drilling fluid (liquid) flowing axially inwardly through the bushing 49 may be substantially decreased. Further, as the retractor tube is moved axially outwardly, either the retractor tube moves the pin 58 to act through the toggle linkage, or if such linkage is not used but with spring mechanism (not shown) urging the latches to their latch seated position, the inner edges 83B of the latch slots 83 abut against the latches to retract the latches. Prior to the pin 58 abutting against the outer ends of latch body slots 77, the ball member 99 has been moved sufficiently outwardly relative to the bushing 49 to, as the latch body is retracted, permit fluid flow through the bushing 49 and depending on the characteristics of spring 70, the ball 77 being moved inwardly against the action of the spring 70, whereby resistance to the retraction of the inner tube assembly and the latch body may be reduced if the amount of liquid to be drained out of the outer end of the drill string is to be reduced.

If desired, bushings 49, and/or the valve ball member 99 (with unthreading of screws 103) may be replaced by unthreading and rethreading the latch body portions 43, 44. By unthreading the outer adaptor part 45 from the inner adaptor part 46, the bushing 50 and then the spring 70 and valve ball member 71 may be removed and replaced with an appropriate bushing and/or valve ball 71 and/or spring 70 to change the inward fluid pressure required to permit inward fluid flow through the bypass channel.

It is to be understood it is possible to use the core barrel inner tube assembly of each of the embodiments without one of the valve assemblies V and T, although it is desirable to use both. With the valve assembly V, if the head assembly becomes stuck in the drill string or both latches fail moving to their latch seated position, the ball member 99 remains in it closed position and pressure will continue to build until the pump's valve (not shown) blows or the pump drive stalls. Even though the head assembly of this invention can be used without valve assembly T, it provides a more complete fluid seal during pumping in the inner tube assembly, particularly when there is leakage pass the valve assembly V, whereby there is an increase in pump-in velocity. Further, with a strong spring 70, after the valve member 99 in its inner most open position, the high drilling pressure results in a strong and faster signal being received at the drilling surface upon there being a core blockage or the core receiving being filled and the shut-off valve members expanding in girth.

The core barrel inner tube assembly of either embodiment described herein may be readily converted to one primarily for down-hole drilling by unthreading the inner and outer adaptor parts from the latch body inner and outer portions 44, 46, remove bushing 50 and ball 71 and possibly removing and if desired, replacing spring 70 with one for abutting against ball member 99 and thence threading main body portion 44A into inner body portion 46E. In such an event, an axially shorter adaptor coupling would be used. To be noted, advantageously the axial lengths of main body portion 44A and inner adaptor portion into which portion 45B is threaded are the same whereby the flange 44C is abuttable against the outermost transverse surface of the inner body portion 46. As another alternative, the adaptor parts may be unthreaded, the fluid seals 28 removed and then the adaptor parts threaded together.

Even though, as disclosed above, there is provided a single latch pivot, it is to be understood that there may be provided two latch pivots in parallel relationship with one latch being pivotally mounted by each latch pivot as long as the latch pivots and the link pivots are located such that the links and latches will move between latch seated and latch retracted positions and the spring 118 constantly urges them to a latch seated position.

What is claimed is:

1. A drilling head assembly having an axially extending central axis and being axially movable in a drill string having an inner peripheral surface to a position adjacent to the bit end of the drill string to latchingly engage a drill string latch seat and being retractable through the drill string in a direction outwardly of the bit end, comprising an axially elongated latch body having an enlarged diametric portion providing a latch body shoulder, a fluid bypass channel that includes an axially extending bore, a first port opening radially outwardly axially outwardly of the enlarged diametric portion and opening to the bore and a second port opening radially outwardly axially inwardly of the enlarged diametric portion and opening to the bore axially inwardly of the first port opening to the bore, annular resilient fluid seal means mounted to the latch body axially intermediate the radially outwardly opening of the first port and the radially outwardly opening of the second port, the maximum outer diameter of the annular seal means being greater than the maximum outer diameter of the enlarged diametric portion, a latch assembly mounted to the latch body for movement between a latch seated position and a latch retracted position, spring means acting between the latch body and the latch assembly for constantly resiliently urging the latch assembly toward its latch seated position, retractor means mounted to the latch body for limited axial movement relative to the latch body between an inner latch seated position and a retracted axial outer position to retract the latch body, said retractor means extending axially outwardly of the enlarged diametric position and including an overshot coupling device, and valving mechanism for controlling fluid flow through the bypass channel.

2. The apparatus of claim 1 wherein the valving mechanism includes a first bushing mounted in the bore axially intermediate the openings of the ports to the bore, a valve assembly extending within the bore for movement relative to the latch body between an axial outer fluid channel open first position and an axial inner second position more closely adjacent to the bushing than in its outer position for cooperating with the bushing to one of substantially restricting inward fluid flow through the bushing and blocking inward fluid flow through the bushing, and means for mounting the valve assembly to the retractor means for limited axial movement relative thereto and being moved from its second axial inner position to its axial outer first position by the retractor means being moved from the retractor means latch seated position to its retracted position.

3. The drilling apparatus of claim 2 wherein the valve assembly is mounted to the latch retractor for movement relative thereto to a third position axially inwardly of its second position for one of permitting axial flow therethrough and permitting increased axial flow therethrough.

4. The drilling apparatus of claim 2 wherein a second bushing is mounted in the bore axially inwardly of the first bushing and outwardly of the opening of the second port to the bore and valve means is provided in the bore and resiliently urged to abut against the second bushing for blocking fluid flow from the second port to the bore and thence to the first port while permitting pressurized fluid flow from the bore to the second port.

5. The drilling apparatus of claim 1 wherein the latch body has an axial outer main body portion with the first port therein, an inner body portion with the second port therein and an adaptor assembly extending axially between and removably coupling the main body portion to the inner body portion, the adaptor assembly mounting the fluid seal means axially outwardly of the latch body enlarged diametric portion and axially inwardly of the latch retractor, the adaptor assembly having a bore portion extending axially therethrough that defines a part of the bypass channel bore.

6. The drilling apparatus of claim 5 wherein the fluid seal means comprises a first and a second seal member that each includes a first annular portion in abutting relationship to the adaptor assembly, a second annular portion of larger diameter than the first annular portion and a web portion joining the first and second annular portions to one another to provide an axially opening annulus.

7. The drilling apparatus of claim 5 wherein a drilling tool is mounted to the latch body to extend axially inwardly thereof.

8. The drilling apparatus of claim 5 wherein the adaptor assembly has an axial inner part that in cooperation with the inner body portion provides an annular outwardly opening landing ring groove and the latch body enlarged diametric portion comprises a landing ring removably mounted in said groove.

9. The drilling apparatus of claim 5 wherein the adaptor assembly includes an axial outer part that in cooperation with the main body portion provide a radially inwardly opening groove with the first bushing mounted therein.

10. The drilling apparatus of claim 5 wherein the adaptor assembly includes an axial outer adaptor part having an transverse inner surface abutting against the seal means and an axial inner adaptor part having a transverse surface axially spaced from the outer adaptor part transverse surface and abutting against the seal means axially opposite from the outer adaptor part transverse surface, one of the adaptor parts having a reduced diameter portion extending through the seal means and being removably connected to the other adaptor part.

11. The drilling apparatus of claim 10 wherein the adaptor outer part has an outer annular portion, the main body portion has an axial inner, reduced diameter annular part threadedly extended into adaptor outer part annular portion, the inner body portion has an axial outer annular part and the adaptor inner part has an axial inner, reduced diameter annular portion threadedly extended into the inner body portion annular part, the main body annular part being adapted for being threadedly extended into the inner body portion annular part.

12. The drilling apparatus of claim 10 wherein the latch body has an axially elongated slot, the retractor means is mounted to the latch body by a transverse pin extended through the slot and mounted to the retractor means in fixed axial relationship thereto, the latch assembly comprises first and second latches having inner ends mounted to the latch body for pivotal movement between a latch seated and latch retracted positions and outer ends and toggle links having radial outer ends pivotally connected to the outer ends of the latches and opposite adjacent ends pivotally mounted by the transverse pin and a spring acting against the latch body and at least one of the pin and the links to urge the latches to their latch seated position.

13. The drilling apparatus of claim 12 wherein the latches are movable to a third pivoted position intermediate their latch seated and retracted positions to, through the links and pin, limit the movement of retractor means relative to the latch body to a position axially intermediate its latch seated and latch retracted position, the valving mechanism includes a first bushing mounted in the bore axially intermediate the openings of the ports to the bore, said bushing having a transverse minimum diameter portion, a valve assembly extending within the bore for controlling fluid flow through the bypass channel, said valve assembly including a valve ball member having a maximum transverse diameter section of a diameter for cooperating with the bushing to one of substantially restricting inward fluid flow through the bushing and blocking inward fluid flow through the bushing when in the bushing minimum diameter portion and means for mounting the ball member to the retractor means for limited axial movement relative thereto and being moved therewith from a first axial outer fluid channel open position when the retractor means is in its retracted position, to a position the ball member diametric section is in the bushing minimum diameter portion and to a third position the ball member diametric section is axially inwardly of the bushing minimum diameter section only when the retractor means is in its latch seated position and both latches are in their latch seated position.

14. A drilling apparatus head assembly that is retractable axially outwardly in and movable axially inwardly in a drill string that has an inner peripheral surface, a bit end at the inner end thereof, a latch seat adjacent to and axially outwardly of the bit end and a drill string landing shoulder axially adjacent to the latch seat, comprising an axially elongated latch body having a central axis, an enlarged diametric portion providing a latch body shoulder seatable on the drill string shoulder, a fluid bypass channel that includes a first port opening radially outwardly axially outwardly of the latch body shoulder, a second port opening radially outwardly axially inwardly of the latch body shoulder and an axially extending bore having the first and second ports opening thereto in axial spaced relationship, a latch mounted to the latch body for movement between a latch seated position and a retracted position permitting the latch body being retracted through the drill string, means acting between the latch body and the latch for resiliently urging the latch to its latch seated position, valving mechanism extending within said bore for blocking significant axial outward fluid flow through the bypass channel to the first port while permitting axial inward fluid flow through the bypass channel from the first port to the second port upon axial inward fluid pressure exceeding a preselected level, retractor means extending axially outwardly of the enlarged diametric portion for retracting the latch body, said retractor means being mounted to the latch body for limited axial movement relative thereto between an axial inner position and an axial outer position to retract the latch body and annular, drill string engagable fluid seal means mounted to the latch body axially intermediate the radial outward opening of the first and second ports and axially intermediate the latch body shoulder and the retractor means for preventing fluid bypassing the latch body between the latch body and the drill string.

15. The drilling apparatus of claim 14 wherein there is provided second valving mechanism movably connected to the retractor means to have a closed first position for at least substantially restricting axial inward fluid flow through the bypass channel as the head assembly is fluidly propelled axially inwardly in a drill string and after the latch body enlarged diametric portion seats on the drill string landing shoulder movable to a valve open second position and being movable to a valve open third position when the retractor means is moved to its axial outer position.

16. The drilling apparatus of claim 14 wherein the latch body includes a main body portion having a reduced outer diameter annular part, an inner body portion having an axial outer annular part, an adaptor assembly having an axial outer part that includes an axial outer reduced diameter annular portion extended into the main body portion annular part and removably connected thereto and an axial inner part having an axial inner reduced outer diameter annular part extended into the inner body portion annular part and removably connected thereto, the fluid seal means being mounted to the adaptor assembly.

17. The drilling apparatus of claim 16 wherein the adaptor assembly and inner body portion cooperatively provide a radially outwardly opening groove and the latch body shoulder comprise a landing ring removably mounted in said groove.

18. The drilling apparatus of claim 16 wherein one of the adaptor assembly axial inner part and the adaptor assembly axial outer part has an axial outer reduced outer diameter portion axially intermediate their annular portions and that the fluid seal means comprises a resilient seal member having a radial inner peripheral surface in engagement with the axial outer reduced diameter part and a radial outer peripheral surface for sealingly engaging the inner peripheral surface of the drill string.

19. A drilling apparatus head assembly comprising an axially elongated latch body having a central axis, an enlarged diametric portion providing a latch body shoulder, a fluid bypass channel that includes a first port opening radially outwardly axially outwardly of the latch body shoulder, a second port opening radially outwardly axially inwardly of the latch body shoulder and an axially extending bore having the first and second ports opening thereto in axial spaced relationship, a latch mounted to the latch body for movement between a latch seated position and a retracted position, means acting between the latch body and the latch for resiliently urging the latch to its latch seated position, valving mechanism extending within said bore for controlling fluid flow through the bypass channel between the first port and the second port, retractor means extending axially outwardly of the enlarged diametric portion for retracting the latch body, said retractor means being mounted to the latch body for limited axial movement relative thereto between an axial inner position and an axial outer position to retract the latch body, the latch body including a main body portion having a reduced diameter axial inner annular part, an inner body portion having an axial outer annular part, and an adaptor assembly having an axial outer part that includes an axial outer annular portion having the main body portion annular part extended thereinto and removably connected thereto and an axial inner part having an axial inner reduced outer diameter annular portion extended into the inner body portion annular part and removably connected thereto, one of the adaptor assembly axial inner part and the adaptor assembly axial outer part having an adaptor reduced outer diameter portion axially intermediate their annular portions and fluid seal means for forming a fluid seal with a drill string, the fluid seal means comprising a resilient seal member having a radial inner peripheral surface in engagement with the adaptor intermediate reduced diameter portion and a radial outer peripheral surface drill string engagable surface, the seal member being mounted to the latch body axially intermediate the radial outward opening of the first and second ports and axially intermediate the latch body shoulder and the retractor means.

20. The drilling apparatus head assembly of claim 19 wherein the main body annular part is adapted for being threadedly extended into the inner body portion annular part and the valving mechanism comprises means for blocking significant axial outward fluid flow through the bypass channel to the first port while permitting axial inward fluid flow through the bypass channel from the first port to the second port upon axial inward fluid pressure exceeding a preselected level.

21. The drilling apparatus head assembly of claim 19 wherein the latch is movable to an intermediate position between its latch seated and its retracted positions and the valving mechanism includes latch body means for defining a reduced inner diameter part of the bore and a valve assembly in the bore that is mounted to the retractor means for movement therewith and relative thereto between a first position to at least substantially restrict fluid flow through the diameter part prior to the latch moving to its latch seated position, a valve open second position axially inwardly of the first position and movable to a valve open third position axially outwardly of its first position by the retractor means moving to its retracted position.

* * * * *